US006619558B1

(12) United States Patent
Jang

(10) Patent No.: US 6,619,558 B1
(45) Date of Patent: Sep. 16, 2003

(54) SUPPORT FOR SUPPORTING RAIL OF RAILWAY

(75) Inventor: Young Gil Jang, Kyunggi-do (KR)

(73) Assignees: Bum Chae Jung, Seoul (KR); Gye Jun Lee, Seoul (KR)

( * ) Notice: Subject to any disclaimer, the term of this patent is extended or adjusted under 35 U.S.C. 154(b) by 0 days.

(21) Appl. No.: 10/111,468

(22) PCT Filed: Nov. 17, 2000

(86) PCT No.: PCT/KR00/01326

§ 371 (c)(1),
(2), (4) Date: Apr. 23, 2002

(87) PCT Pub. No.: WO01/36749

PCT Pub. Date: May 25, 2001

(30) Foreign Application Priority Data

Nov. 18, 1999 (KR) ..... 99-51385
Nov. 18, 1999 (KR) ..... 99-51386

(51) Int. Cl.[7] ..... E01B 9/00
(52) U.S. Cl. ..... 238/283; 238/264; 238/307
(58) Field of Search ..... 238/264, 283, 238/382, 349, 351, 307

(56) References Cited

U.S. PATENT DOCUMENTS 348,782 A * 9/1886 Sawyer ..... 52/177
1,659,844 A * 2/1928 Tupper ..... 238/283
2,076,019 A * 4/1937 Fifield ..... 238/283
2,110,894 A * 3/1938 Stedman ..... 238/302
2,609,991 A * 9/1952 Jones ..... 238/283
2,713,974 A * 7/1955 Lofton ..... 238/283
5,335,850 A * 8/1994 Igwemezie ..... 238/283
5,730,357 A * 3/1998 Besenschek et al. ..... 238/283

FOREIGN PATENT DOCUMENTS

JP 5493907 7/1979
JP 59163603 11/1984
KR 9811071 5/1998

OTHER PUBLICATIONS

Partial English translation of JP 591636t03 dated Nov. 1, 1984.
Partial Englsih translation of JP 5493907 dated Jul. 3, 1979.
Partial English translation of KR9811071 dated May 25, 1998.

* cited by examiner

*Primary Examiner*—Mark T. Le
(74) *Attorney, Agent, or Firm*—Ladas & Parry

(57) ABSTRACT

A railway rail support has a fixing plate with a flat body with an upper surface for receiving a rail, left and right fixing portions and front and rear extended support portions respectively extending from opposite sides of the body, and a through hole at a center portion of the body. A buffering plate for elastically supporting a lower portion of the fixing plate has a support portion for projecting through the through hole of the fixing plate to an upper surface protruded beyond the upper surface of the fixing plate, whereby to decrease impact of the rail.

14 Claims, 14 Drawing Sheets

SUPPORT FOR SUPPORTING RAIL OF RAILWAY

BACKGROUND OF THE INVENTION

1. Field of the Invention

The present invention relates to a support for supporting a rail of a railway capable of effectively relaxing an impact and absorbing a vibration of a railway rail installed on a precast concrete tie, and in particular to a support for supporting a rail of a railway by which an easier construction and an excellent durability are implemented by providing a structurally engaged buffering plate.

2. Description of the Background Art

FIG. 14 is a disassembled perspective view illustrating a fixing structure of a conventional rail of a railway.

As shown therein, a conventional rail 4 of a railway is pressurized by an e-shaped rail fixing clip 8 which is fixed in such a manner that an insulation pad 7 is mounted on a precast concrete tie 2, and a flange portion 4*a* is inserted into a fixing hole 5*a* of a rail fixing clip plate 5 embedded in the tie 2. The railway rail 4 is fixed on a rail support 1 on the tie 2 in such a manner that the flange portion 4*a* is pressurized by the rail fixing clip 8 fixed in such a manner that the flange portion 4*a* is inserted in the plate 5 on the insulation pad 7 of an elastic material(a polyurethane material) which is used for a buffering and insulation purpose. An elastic insulation plate 6 is disposed between the rail fixing clip 8 and the rail flange portion 4*a*.

A dynamic weight and an impact of a train which moves on the railway rail 4 is first buffered by the insulation pad 7 and is transferred to the tie 2. The dynamic weight and impact which are first buffered by the insulation pad 7 are last absorbed for thereby preventing a vibration noise and stably supporting the railway rail 4.

However, in the above-described conventional railway rail, the insulation pad 7 is attached on the tie 2 using an adhesive. Therefore, the adhesive durability is very weak. If the weight and impact from the train which moves on the rail 4 are accumulated after a certain period is passed, the insulation pad 7 is escaped from the tie 2 and the rail 4. Thereafter, the construction of the railway is completed, the insulation pad 7 must be periodically changed. Namely, since the period of the adhesive durability of the insulation pad 7 is short, the insulation pad 7 is escaped. In this case, the weight and impact force of the train which moves on the rail 4 is directly transferred to the tie, so that the lifespan of the tie 2 is significantly decreased, and a metallic friction noise occurs between the rails 4 for thereby causing a noise pollution. Therefore, after the railway is constructed, whenever the period of the durability of the insulation pad 7 is passed, a periodic maintenance is needed for changing the insulation pad.

In addition, in the conventional railway rail fixing structure, when performing a maintenance work for initially constructing the rail or changing the insulation pad, the operations for applying an adhesive on the insulation pad 7 and attaching the insulation pad 7 on the tie are manually performed. Namely, an insulation pad attaching operation is manually performed. Therefore, the assembling quality is bad, and the construction period of the railway rail is extended, and the construction cost and the maintenance cost of the railway rail are increased.

Recently, since it is difficult to purchase gravels for being graveled on the railway, the railway rail is generally installed on the precast concrete tie. In the case of the railway rail which is installed on the concrete tie, a steel or concrete single tie or a wooden tie is used as a rail support. However, in this case, the insulation pad which is applied with an adhesive is used, the above-described problems occur. In addition, in the case that the rail is installed on the concrete railway, a steel or single tie which is used as a rail support is previously embedded, and then the concrete railway is hardened for thereby causing much inconvenience.

SUMMARY OF THE INVENTION

Accordingly, it is an object of the present invention to provide a railway rail support which includes a fixing plate formed of a flat body on which a rail is installed and left and right fixing portions extended in a horizontal direction from both sides of the body, the body including a through hole at a center portion of the same, and a buffering plate engaged to a lower portion of the fixing plate for elastically supporting the fixing plate and including a buffering plate support portion inserted into the center portion through the through hole of the fixing plate and having an upper surface protruded beyond the upper surface of the fixing plate for thereby supporting the rail and decreasing the weight and impact of the rail.

The left and right fixing portions of the fixing plate are extended based on a width smaller than the body.

A movement prevention shoulder portion is formed along an edge portion of the lower surface of the fixing plate for preventing a movement of the buffering plate.

A plurality of sliding prevention protrusions are formed on a lower surface of the rail on the upper surface of the buffering support portion of the buffering plate.

A plurality of buffering protrusions are arranged in a lattice shape on a lower surface of the buffering plate.

The fixing plate includes left and right fixing members at both sides of the through hole for supporting the rail fixing clip.

A fixing hole into which the rail fixing clip is inserted passes through the interior of the left and right fixing members in the forward and backward directions.

The left and right fixing holes are an elongated hole having a cross section in the horizontal direction.

The fixing plate includes an extended support portion having a width smaller than a horizontal width of the body and extended from the front and rear portions of the body.

A rail mounting groove is further formed at a center portion of an upper surface of the body of the fixing plate for mounting a rail therein.

A rail mounting groove is further formed in the body of the fixing plate and at a center portion of the upper surface of the extended support portion for mounting the rail therein, and an extended buffering portion extended in a horizontal direction from the front and rear portions of the buffering support portion of the buffering plate is formed for thereby supporting the lower portion of the rail mounted in the mounting groove.

The left and right fixing holes have an inclination in an angle range of 0~90°.

The inclination angle of the left and right fixing holes is 45°.

A bolt hole is formed for engaging a bolt for fixing the rail fixing clip fixing plate at both sides of the through hole.

DETAILED DESCRIPTION OF THE PREFERRED EMBODIMENTS

Figure 1:
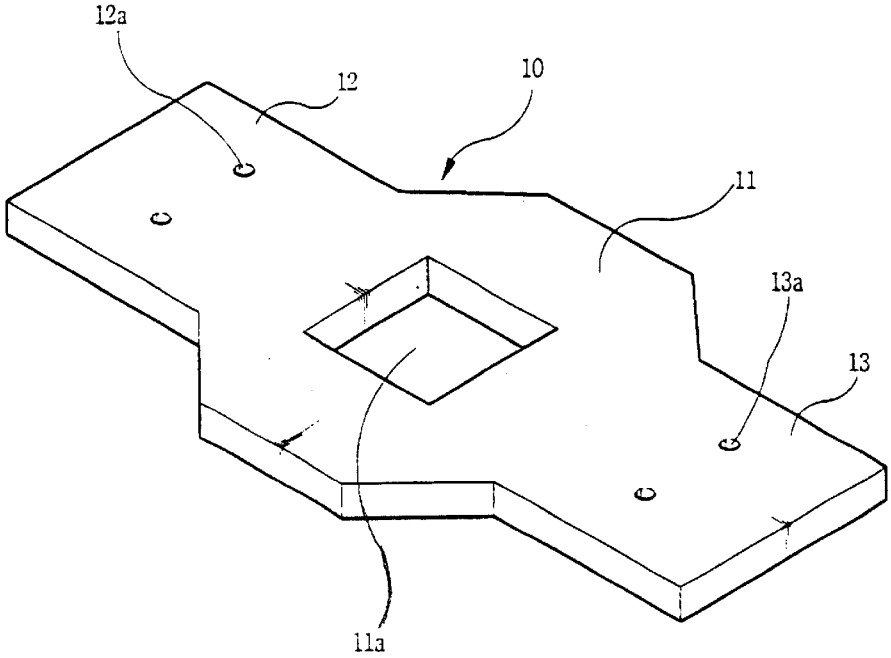
FIG. 1 is a perspective view illustrating a fixing plate of a railway rail support according to a first embodiment of the present invention.

As shown in FIG. 1, a railway rail support according to the present invention includes a fixing plate 10, and a buffering plate 20 engaged to a lower portion of the fixing plate 10.

Figure 3:
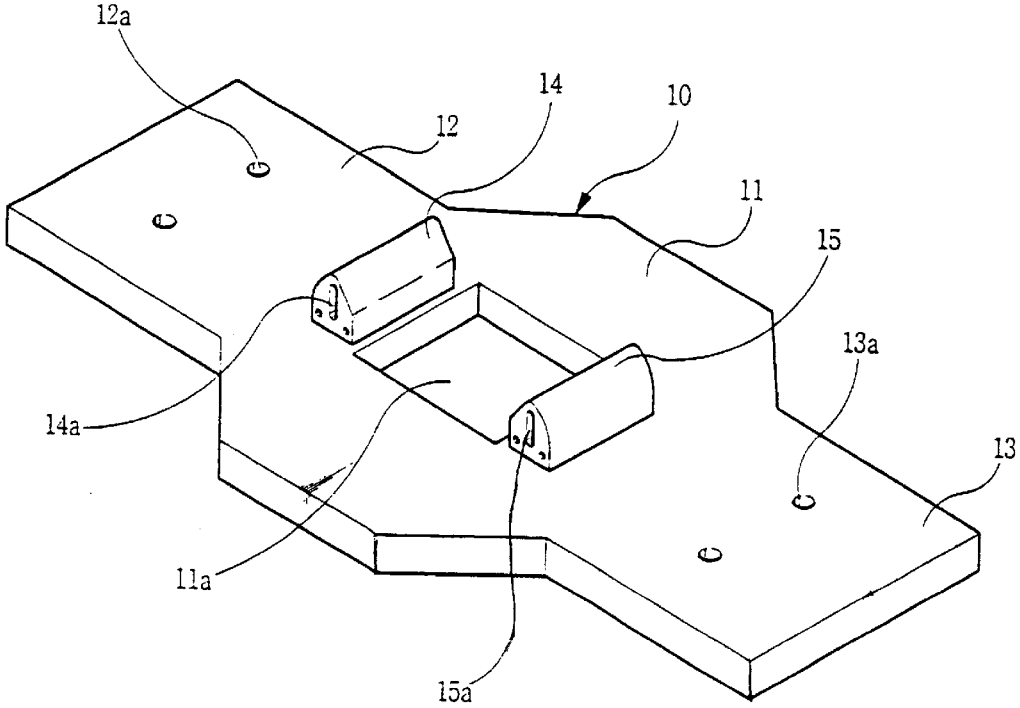
FIG. 3 is a perspective view illustrating a state that a rail fixing clip fixing member is integrally formed.

The fixing plate 10 includes a pentagonal body 11 having a rectangular through hole 11*a* formed at a center portion of the same and left and right fixing portions 12 and 13 extended in parallel from both sides of the body 11 and having bolt engaging holes 12*a* and 13*a*. A movement prevention shoulder portion(16 of FIG. 5) is formed along an edge portion of the same and is fixed to a concrete railway (30 of FIG. 5) together with the buffering plate 20 engaged to a lower portion of the same. A fixing member is installed at both sides of the through hole 11*a* of the body 11 for fixing the rail fixing clip 50. In the first embodiment of the present invention, as shown in FIG. 3, left and right fixing members 14 and 15 having fixing holes 14*a* and 15*a* formed in the forward and backward directions are integrally formed or welded.

Figure 2:
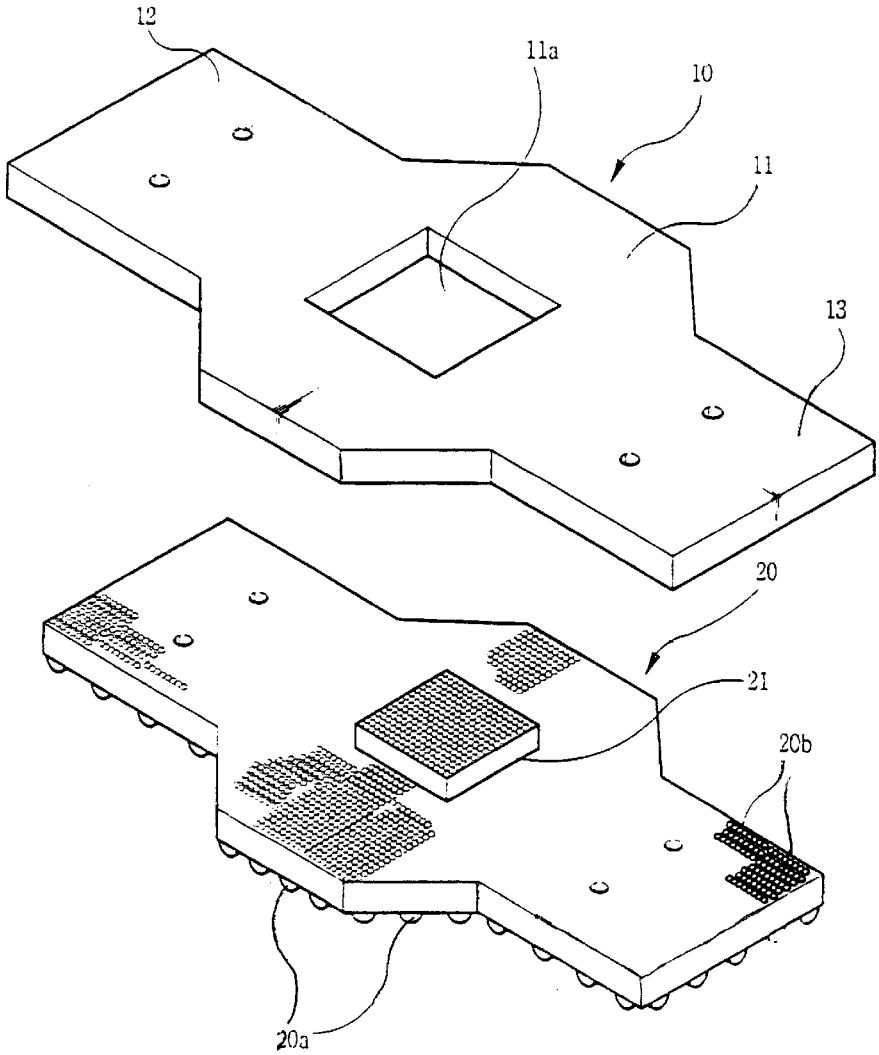
FIG. 2 is a disassembled perspective view illustrating a railway rail support and an buffering plate installed below the same according to a first embodiment of the present invention.

As shown in FIG. 2, the buffering plate 20 is an elastic plate corresponding to the fixing plate 10 and is formed of an elastic material such as a polyurethane or rubber. The buffering plate 20 is structurally engaged to the lower portion of the fixing plate 10 in such a manner that a buffering support portion 21 which is protruded to correspond to the through hole 11*a* of the body 11 at the center portion of the upper surface of the same is inserted into the through hole 11*a* of the body 11 and is fixed in the concrete railway together with the fixing plate 10. An embossed sliding prevention protrusion 20*b* is formed on the entire surface of the same for increasing a friction force so that it is not slid with respect to the rail 40 and the fixing plate 10, and a plurality of buffering protrusions 20*a* are formed on the lower portion for thereby preventing a sliding.

Figure 4:
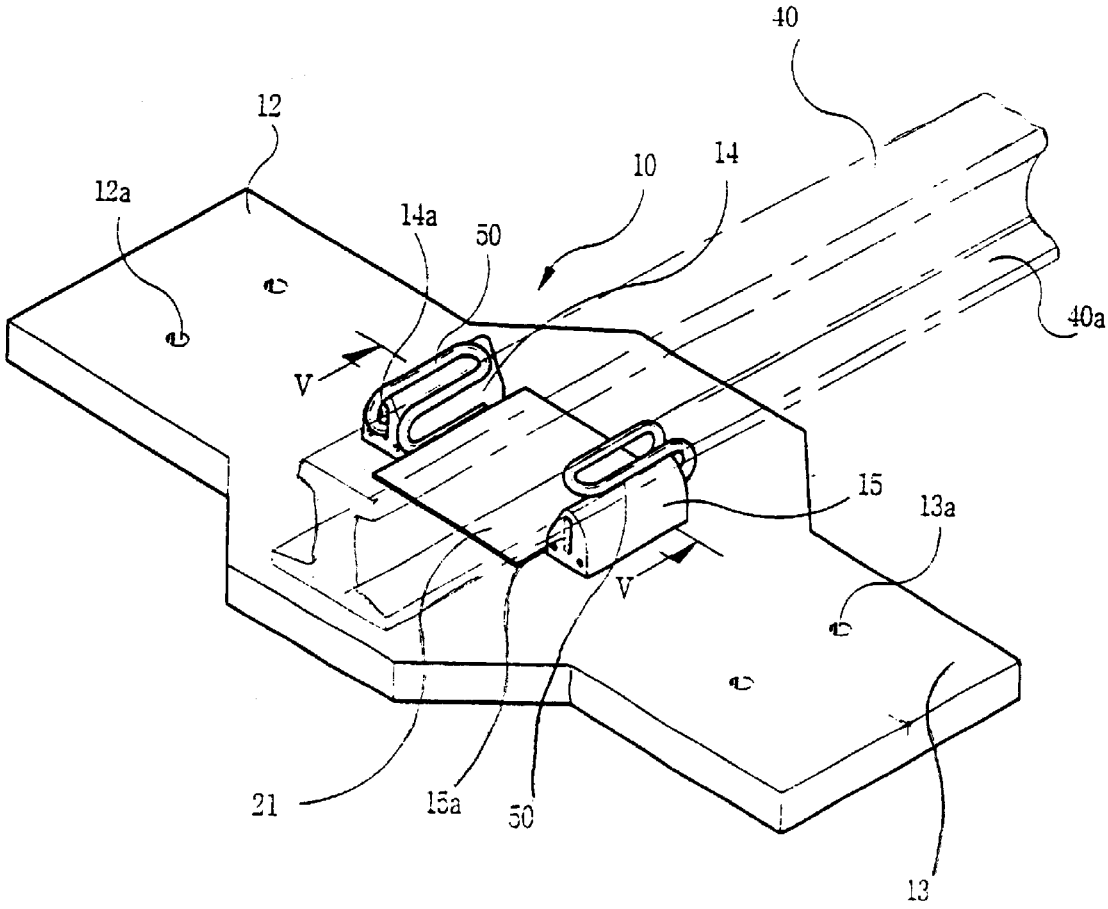
FIG. 4 is a view illustrating a state in use of the same.
Figure 5:
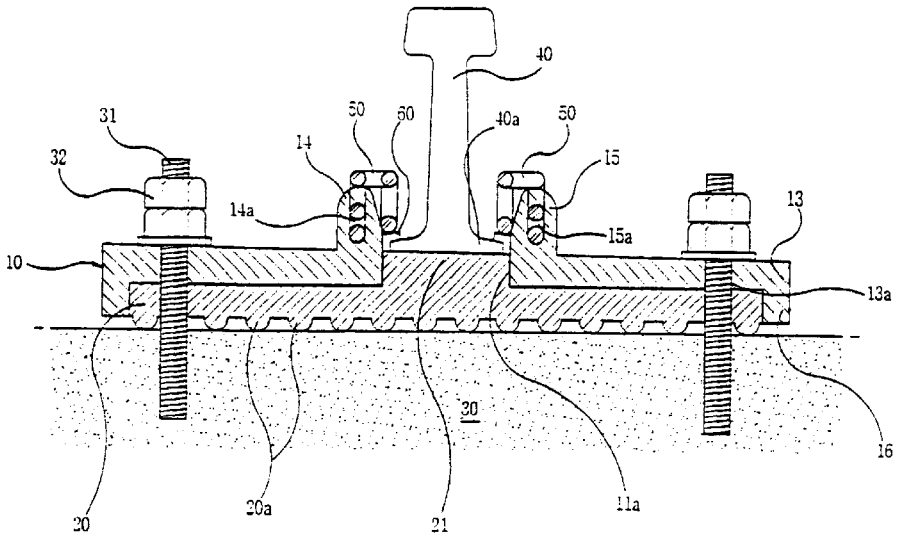
FIG. 5 is a cross-sectional view taken along line V—V of FIG. 4.

As shown in FIGS. 4 and 5, the fixing plate 10 and the buffering plate 20 are structurally engaged in such a manner that the buffering support portion 21 of the buffering plate 20 is inserted into the through hole 11*a* of the fixing plate 10 and are fixed to the concrete railway 30 by an engaging force with respect to the anchor bolt 31 of the nut 32 in such a manner that the anchor bolts 31 embedded in the concrete railway 30 are inserted into the bolt engaging holes 12*a* and 13*a* of the left and right fixing portions 12 and 13 of the fixing plate 10.

The railway rail 40 traverses the center portion of the railway rail support fixed by the anchor bolts 31 in the forward and backward directions over the buffering support portion 21 of the buffering plate 20 exposed through the through hole 11*a* of the fixing plate 10 and are fixed by the fixing clip 50 which is fixed in such a manner that the flange portion 40*a* is inserted into the left and right fixing members 14 and 15 through the elastic insulation plate 60. The railway rail 40 is supported by the buffering support portion 21 of the buffering plate 20 and the fixing plate 10, and the buffering plate 20 and the fixing plate 10 absorb the dynamic weight and vibration applied from a train which moves on the rail 40 for thereby preventing a damage of the concrete railway 30 and a vibration and noise.

In the above described construction, the railway rail support according to the present invention is stably engaged in such a manner that the buffering support portion 21 of the buffering plate 20 is inserted into the through hole 11*a*. Namely, the fixing plate 10 and the buffering plate 20 are not engaged by an adhesive. Therefore, it is possible to prevent the buffering plate 20 from being escaped even when the dynamic weight and impact are repeatedly applied from the train which moves along the rail 40. In addition, since the fixing plate 10 and the buffering plate 20 are engaged in such a manner that the buffering plate 20 is inserted into the through hole 11*a* of the fixing plate 10, an assembling with respect to the fixing plate 10 of the buffering plate 20 is significantly enhanced, and since the left and right fixing members 14 and 15 are integrally engaged to the fixing plate 10 by the rail fixing clip 50, it is possible to simplify the railway rail construction and maintenance.

Therefore, in the case that the railway rail is constructed using a railway rail support according to the present invention, a periodic maintenance is not needed with respect to the railway rail due to a periodic separation of the buffering plate. In addition, it is possible to decrease the maintenance cost. Since the processes for the construction and maintenance of the railway are decreased, the construction period is decreased, and the construction and maintenance costs are decreased.

Figure 6:
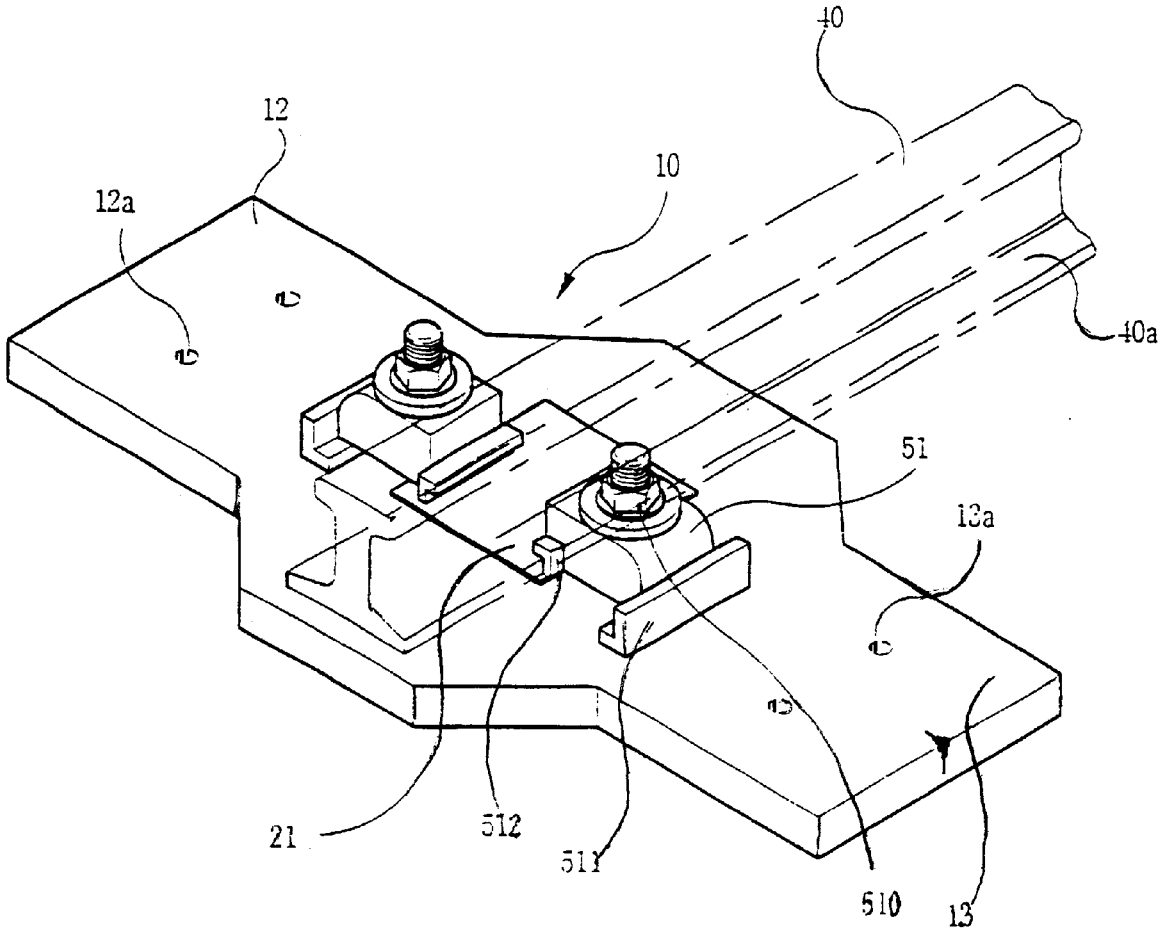
FIGS. 6 through 8 are views illustrating the using states of railway rail supports according to the first embodiment of the present invention.
Figure 8:
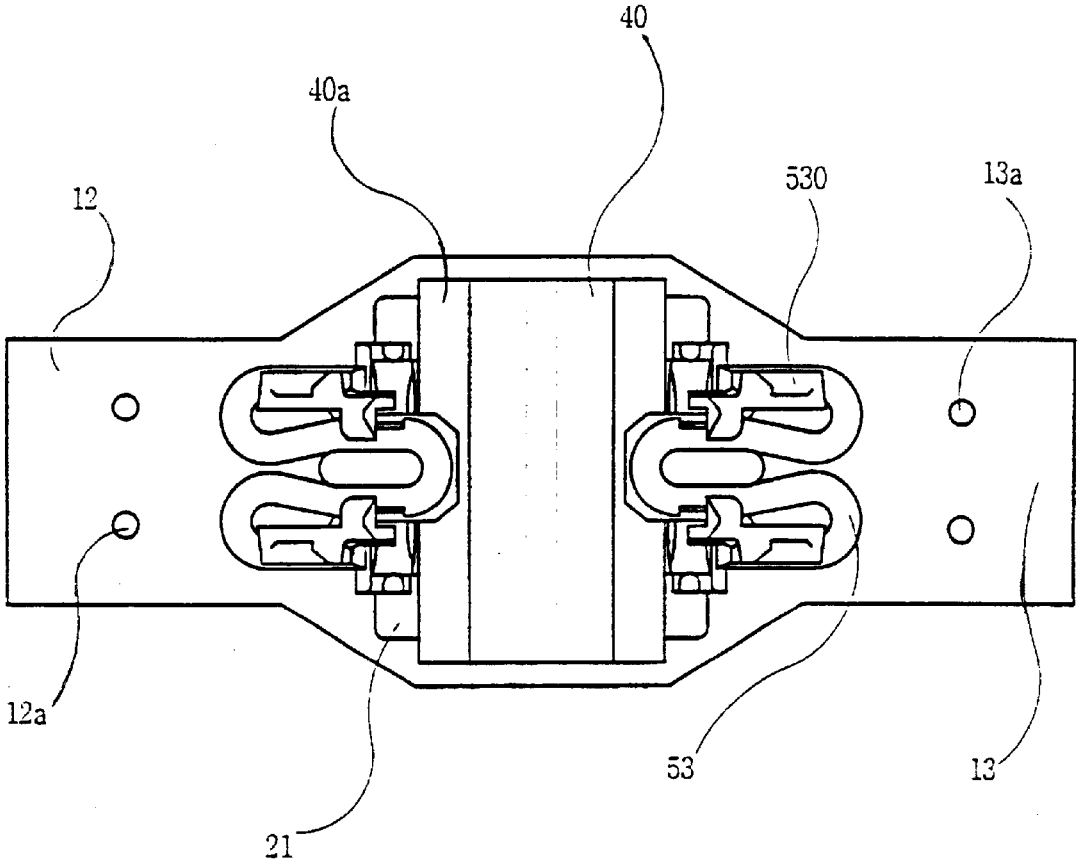

FIGS. 6 and 8 are views illustrating the using states of the railway rail supports according to the first embodiment of the present invention in which other rail fixing clips are used.

Figure 7:
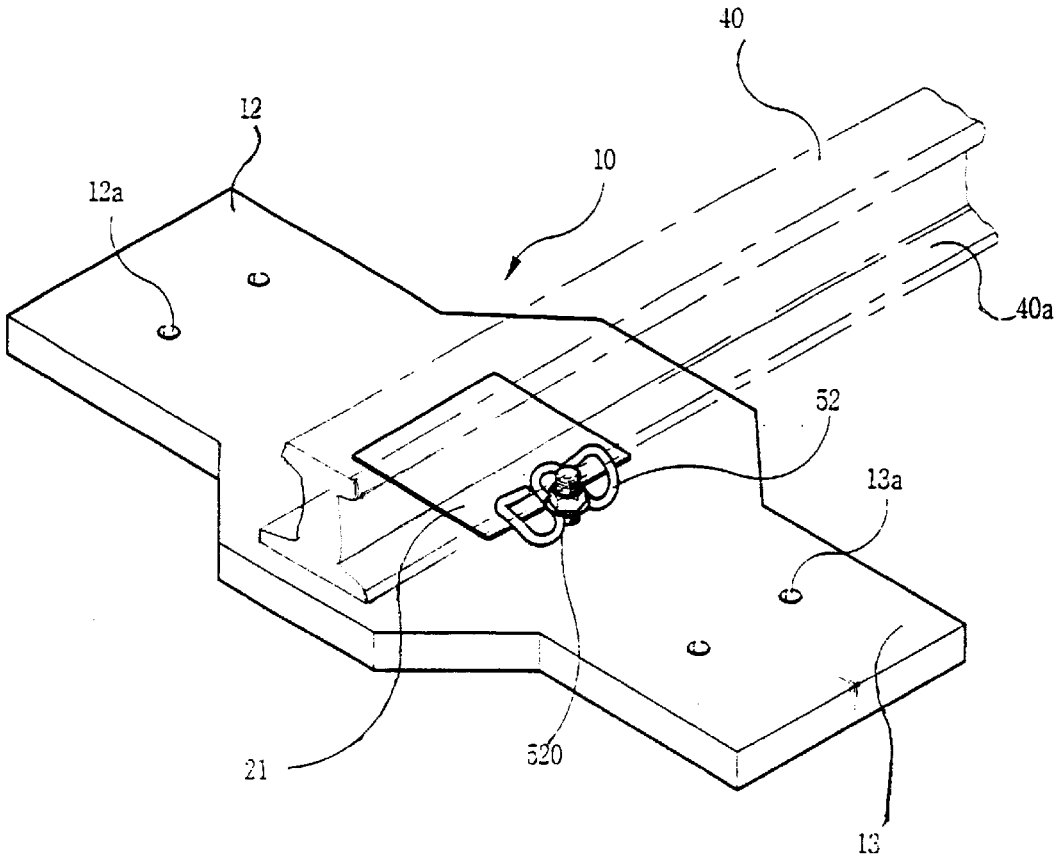

FIG. 6 is a view illustrating a using state of a hexagonal fixing clip 51 having an insulation plate 512 which is fixed by the bolt 510 with respect to the railway rail support according to the first embodiment of the present invention and compensates the difference of the heights. FIG. 7 is a view illustrating a using state of a fixing clip 52 which has a W-shaped structure and is fixed by the bolt 520 with respect to the railway rail support. In addition, FIG. 8 is a view illustrating a Ω-shaped fixing clip 53 fixedly inserted into the fixing member 530 fixed to the fixing plate 10.

Figure 9:
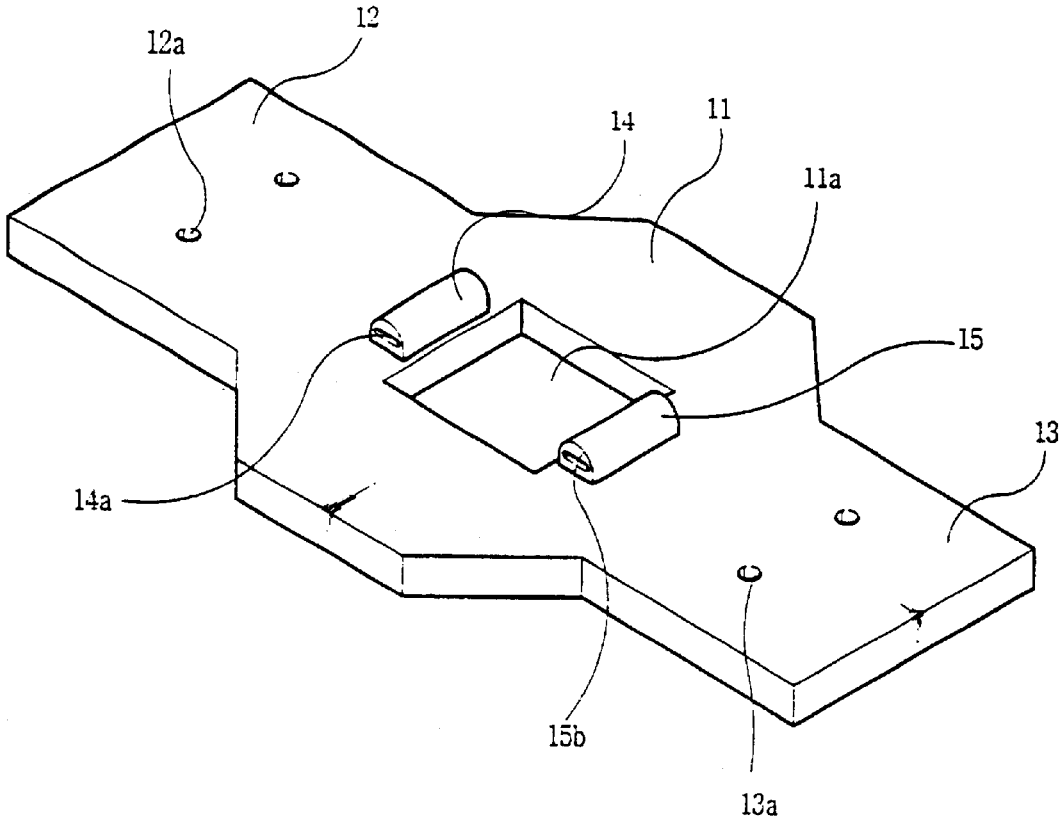
FIGS. 9 through 11 are views illustrating the members used for the railway rail support according to another embodiment of the present invention.
Figure 10:
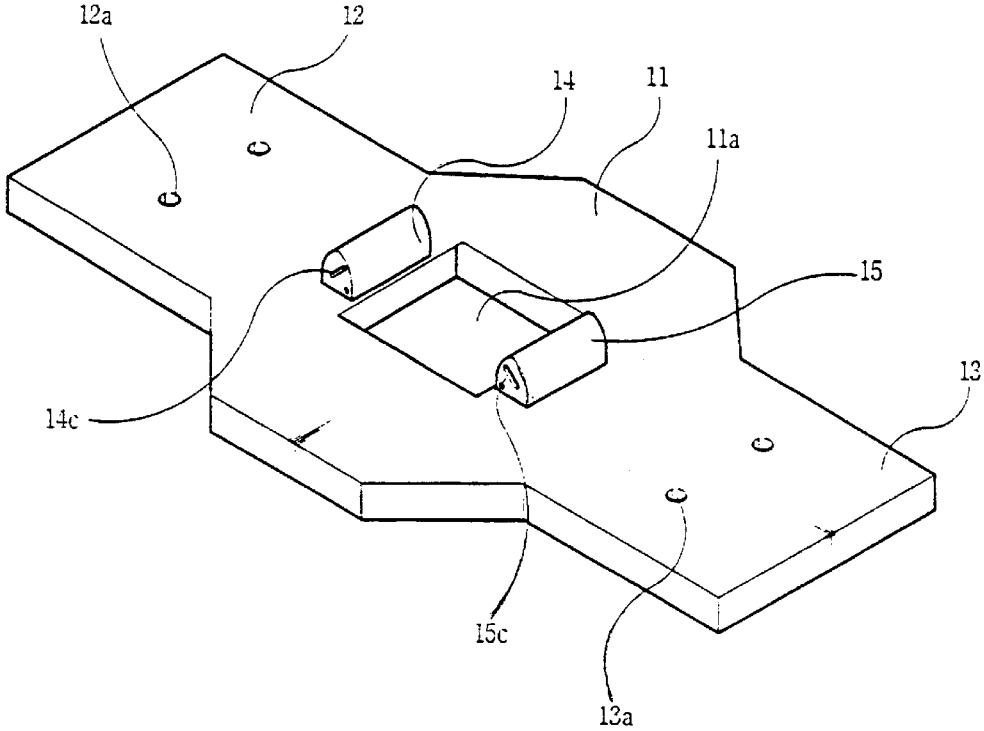
Figure 11:
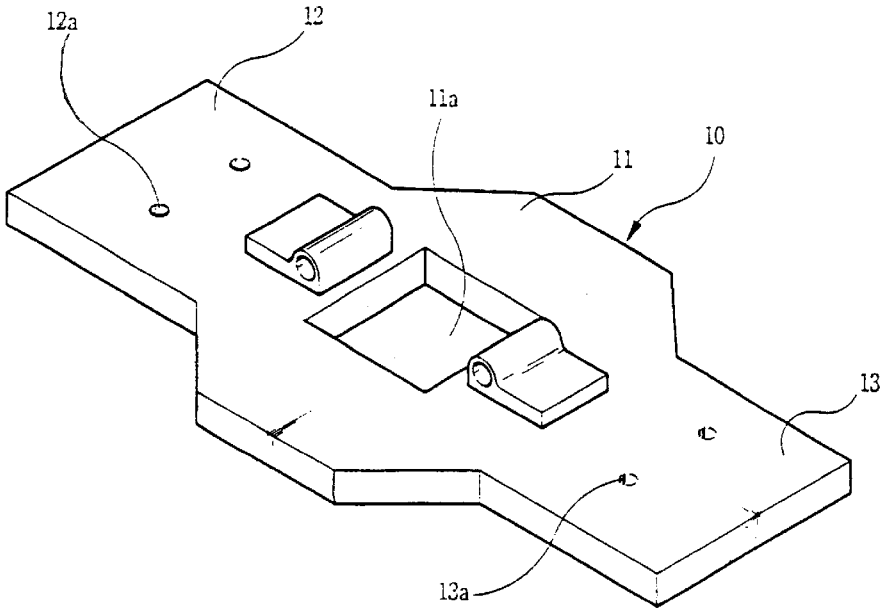

FIGS. 9 through 11 are views illustrating the members used for the railway rail support according to another embodiment of the present invention. As shown therein, the fixing clip fixing member installed in the fixing plate 10 is different in accordance with the fixing clip 50 of FIG. 4 which fixes the railway rail.

Figure 14:
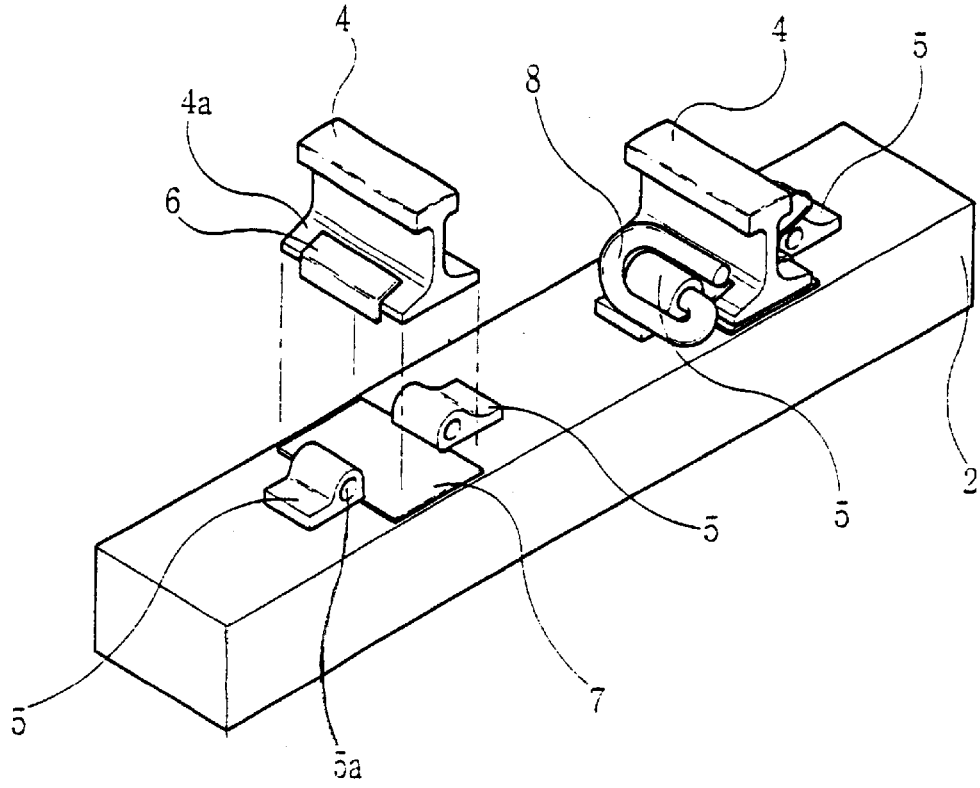
FIG. 14 is a view illustrating the using state of a conventional railway clip.

Namely, the fixing plate of the railway rail support according to the second embodiment of the present invention is a rail fixing clip 50 of FIG. 4 which fixes the rail 40 of FIG. 4 and includes elongated holes 14*b* and 15*b* formed in the left and right fixing members 14 and 15 and having a certain width in the horizontal direction for thereby adapting the rail fixing clip having an insertion portion which has a certain width in the horizontal direction. The fixing plate 10 of the railway rail support according to a third embodiment of the present invention includes elongated holes 14*c* and 15*c* which are formed at a certain angle in the inward direction in the left and right fixing members 14 and 15 for thereby adapting the rail fixing clip having an insertion portion which has a certain width in the inward direction. FIG. 11 illustrate a railway rail support according to a fourth embodiment of the present invention in which a plate 70 is integrally formed at both sides of the through hole 11*a* for thereby adapting the conventional fixing clip 8 of FIG. 14.

Figure 12:
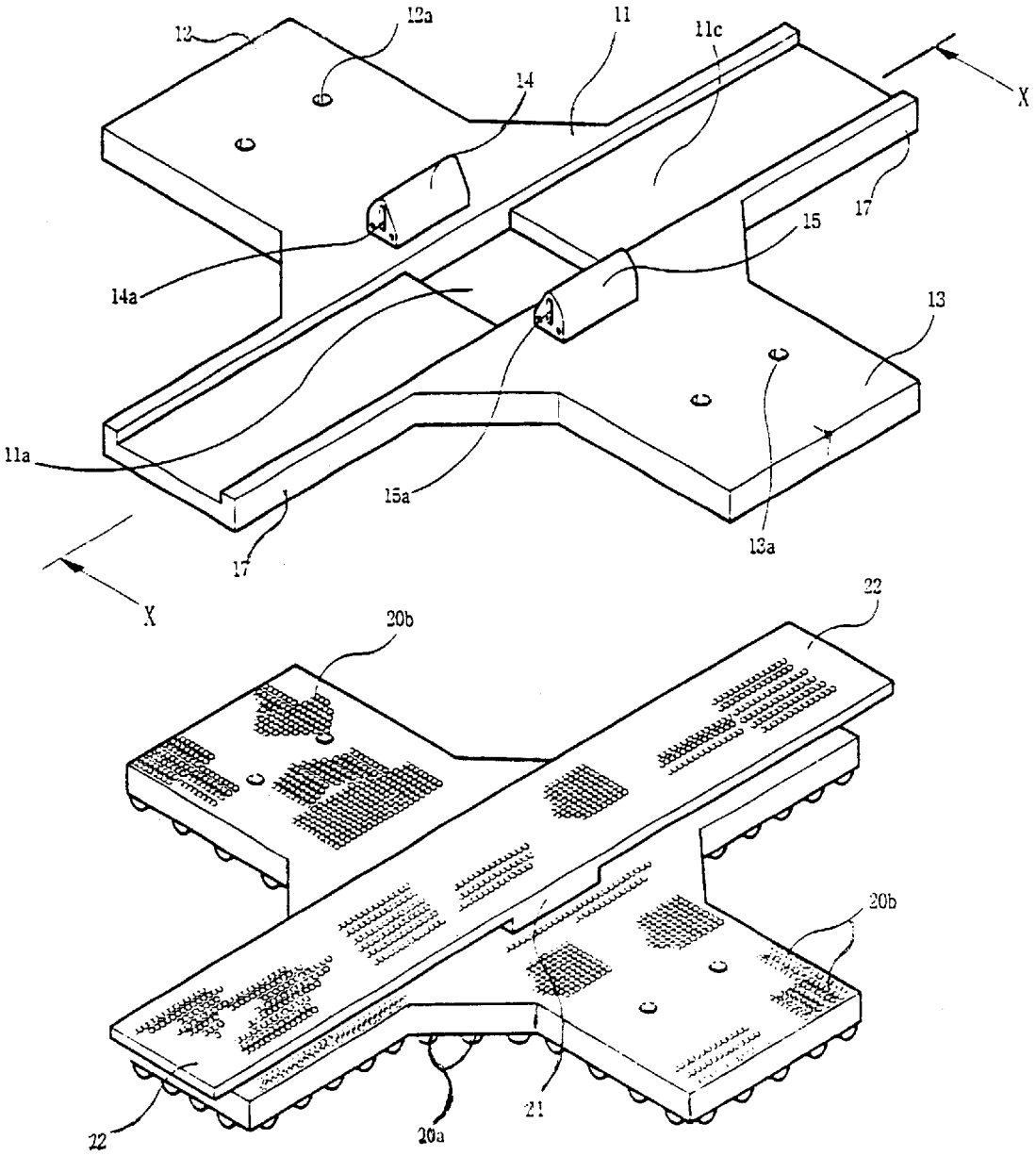
FIG. 12 is a disassembled perspective view illustrating a railway support according to a fifth embodiment of the present invention.
Figure 13:
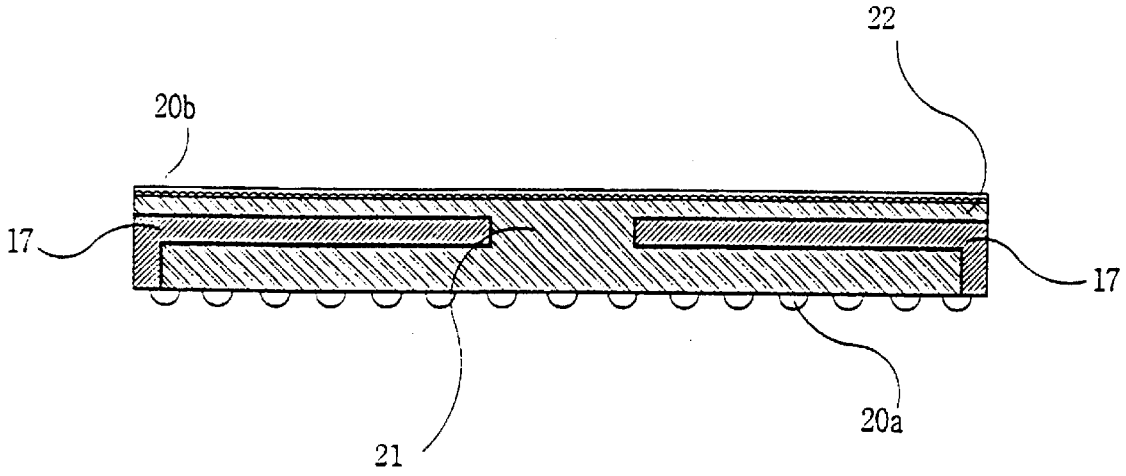
FIG. 13 is a cross-sectional view taken along line X—X in FIG. 12.

FIG. 12 is a disassembled perspective view illustrating a railway rail support according to a fifth embodiment of the present invention, and FIG. 13 is a cross-sectional view taken along line X—X.

The railway rail support according to the fifth embodiment of the present invention is formed in such a manner that the rail support portion 11*b* is extended from front and rear portions of the body 11 of the fixing plate 10 for thereby more stably supporting the rail. The railway rail support has an excellent supporting strength with respect to the railway rail 40 for thereby stably supporting the rail and preventing a vibration and noise. In addition, the railway rail support according to the fifth embodiment of the present invention includes a rail mounting groove 11*c* which traverses the center portion of the fixing plate 10 for thereby easily setting the position of the railway rail 40 when constructing the railway rail. In addition, an engaging force with respect to the railway rail 40 is excellent, and it is possible to prevent a penetration of a foreign material such as dust which causes a noise between the rail and the railway rail support 40 and decreases the life span of the buffering plate. Therefore, in the case of the railway rail support according to the fifth embodiment of the present invention, the railway rail receives a torsion weight from the train and a weight in a lateral direction, so that the railway rail may be escaped from the railway rail support due to a relative movement with respect to the railway rail support. In addition, in the case that the rail is adapted to a curved railway which causes a floating state of the rail from the railway rail support, it is possible to prevent an escape of the rail support from the rail and a penetration of a foreign material into a lower surface of the rail. Therefore, the railway rail support according to the fifth embodiment of the present invention is well adaptable to the curved rail which may be escaped from the railway rail support and may be floated due to a relative movement with respect to the railway rail support by receiving a torsion weight or a weight in the lateral direction from the train or a certain region such as a station region, a school zone or a residential region in which much vibration and noise occur or a rail installed in a region in which a ground foundation is weak.

As described above, the railway rail support according to the present invention may be used as a railway rail installed on the concrete railway which does not need a reinforcement of the ground foundation. In this case, the additional tie is not needed for thereby significantly decreasing the railway construction cost.

In addition, since the fixing plate and the buffering plate are stably engaged with respect to the railway rail support without using an adhesive in the case that the railway rail support according to the present invention is used, it is possible to prevent a periodic separation of the buffering plate or the maintenance. Therefore, it is possible to significantly decrease the railway maintenance cost by using the railway rail support according to the present invention. In addition, the assembling property of the buffering plate is improved, and the rail fixing clip fixing member is integrally formed, the number of the fabrication processes is decreased when assembling the buffering plate and the rail fixing clip fixing member, and the railway construction period and the maintenance period are significantly decreased.

A buffering effect with respect to the rail is excellent, and the rail is supported by the buffering support member of the buffering plate, so that it is possible to decrease the noises due to the dynamic weight and impact of the train.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A railway rail support, comprising:

a fixing plate having a flat body with an upper surface for receiving a rail, left and right fixing portions and front and rear extended support portions respectively extending from opposite sides of the body, and a through hole at a center portion of the body; and a buffering plate for elastically supporting a lower portion of the fixing plate, the buffering plate having a support portion for projecting through the through hole of the fixing plate to an upper surface protruded beyond the upper surface of the fixing plate, whereby to decrease impact of the rail.

2. A railway rail support of claim 1, wherein the left and right fixing portions of the fixing plate extend less than a width of the body.

3. A railway rail support of claim 1, further comprising a movement prevention shoulder portion along an edge portion of the lower portion of the fixing plate for preventing a movement of the buffering plate.

4. A railway rail support of claim 1, further comprising a plurality of sliding prevention protrusions on the upper surface of the support portion of the buffering plate.

5. A railway rail support of claim 1, further comprising a plurality of buffering protrusions on a lower surface of the buffering plate.

6. A railway rail support of claim 1, wherein said fixing plate includes left and right fixing members at opposite sides of the through hole, each for supporting a rail fixing clip.

7. A railway rail support of claim 6, further comprising a fixing hole for the rail fixing clip through the interior of each of the left and right fixing members in forward and backward directions.

8. A railway rail support of claim 6, wherein the left and right fixing members each have an elongated hole having a cross section in a horizontal direction.

9. A railway rail support, comprising:

a fixing plate formed of a flat body on which a rail is installed and left and right fixing portions extended in a horizontal direction from both sides of the body, said body including a through hole at a center portion of the same; and a buffering plate engaged to a lower portion of the fixing plate for elastically supporting the fixing plate and including a buffering plate support portion inserted into the center portion through the through hole of the fixing plate and having an upper surface protruded beyond the upper surface of the fixing plate for thereby supporting the rail and decreasing the weight and impact of the rail, wherein said fixing plate includes an extended support portion having a width smaller than a horizontal width of the body and extended from the front and rear portions of the body.

10. A railway rail support of claim 1, further comprising a rail mounting groove at the center portion of the upper surface of the body of the fixing plate for mounting the rail therein.

11. A railway rail support of claim 9, further comprising:

a rail mounting groove formed in the body of the fixing plate and at a center portion of the upper surface of the extended support portion for mounting the rail therein; and an extended buffering portion extended in a horizontal direction from the front and rear portions of the buffering support portion of the buffering plate for thereby supporting the lower portion of the rail mounted in the mounting groove.

12. A railway rail support of claim 8, wherein the hole has an inclination of more than 0° and less than or equal to 90°.

13. A railway rail support of claim 12, wherein the inclination is 45°.

14. A railway rail support of claim 1, further comprising bolt holes through the fixing plate at opposite sides of the through hole.

* * * * *

UNITED STATES PATENT AND TRADEMARK OFFICE

CERTIFICATE OF CORRECTION

PATENT NO. : 6,619,558 B1
DATED : September 16, 2003
INVENTOR(S) : Young Gil Jang It is certified that error appears in the above-identified patent and that said Letters Patent is hereby corrected as shown below:

Title page,
Item [*] Notice, "0" should read -- 273 --; and
Item [73], Assignee, "Bum Chae Jung, Seoul" should read -- Young Gil Jang, Sungnam --.

Signed and Sealed this

Sixth Day of April, 2004

JON W. DUDAS
*Acting Director of the United States Patent and Trademark Office*